US006274970B1

(12) United States Patent
Capobianco

(10) Patent No.: US 6,274,970 B1
(45) **Date of Patent: *Aug. 14, 2001**

(54) ARC LAMP

(75) Inventor: Robert A. Capobianco, Peabody, MA (US)

(73) Assignee: PerkinElmer, Inc., Wellesley, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,704

(22) Filed: Dec. 30, 1997

(51) Int. Cl.[7] ..... H01J 5/16
(52) U.S. Cl. ..... 313/113; 313/46; 313/117
(58) Field of Search ..... 313/113, 110, 313/634, 567, 581, 114, 116, 117, 46; 362/341, 296

(56) References Cited

U.S. PATENT DOCUMENTS

| | | | | |
|---|---|---|---|---|
| 3,527,974 | * | 9/1970 | Cooper | 313/113 |
| 3,559,546 | * | 2/1971 | McKee | 313/113 |
| 3,731,133 | | 5/1973 | McRae et al. . | |
| 3,766,430 | * | 10/1973 | Schlegel | 313/113 |
| 4,020,379 | * | 4/1977 | Manning | 313/113 |
| 4,188,657 | * | 2/1980 | Reibling | 362/348 |
| 4,599,540 | | 7/1986 | Roberts . | |
| 4,633,128 | | 12/1986 | Roberts et al. . | |
| 5,128,596 | * | 7/1992 | Shimazu et al. | 313/113 |
| 5,399,931 | | 3/1995 | Roberts . | |
| 5,721,465 | | 2/1998 | Roberts . | |

OTHER PUBLICATIONS

Capobianco, R.A., "Xenon: The Full Spectrum vs. Deuterium Plus Tungsten", EG&G Optoelectronics 6/97.

Capobianco,R.A.,"Optical Coupling of Flashlamps and Fiber Optics", EG&G Optoelectronics 6/97.

Capobianco, R.A.,"High–Stabilityt Pulsed Light Systems", EG&G Optoelectronics 6/97.

Advertisement 1100 Series High Stability Short Arc Xenon Flashlamps, EG&G Optoelectronics 2/94.

Advertisement, 1100 Series FlashPacs, EG&G Optoelectronics, 1/97.

Advertisement, 1100 Series Lite–Pac Trigger Modules, EG&G Optoelectronics 2/94.

Advertisement, 1100 Series FX–1160, High Output Short Arc Xenon Flashlamp With Internal Reflector, EG&G Optoelectronics 10/96.

Advertisement, LabPac PS 1200 Laboratory Flashlamp Power Supply, EG&G Optoelectronics 1/97.

Advertisement, 1100 Series Power Supplies, EG&G Optoelectronics 2/94.

Advertisement, 1100 Series Short Arc Flashlamps, Trigger Modules and Power Supplies, EG&G Optoelectronics 1/94.

* cited by examiner

*Primary Examiner*—Nimeshkumar D. Patel
*Assistant Examiner*—Joseph Williams
(74) *Attorney, Agent, or Firm*—Iandiorio & Teska

(57) ABSTRACT

An arc lamp includes a housing; an inert gas in the housing; a pair of spaced electrodes in the housing for establishing an arc in the gas to generate a radiation output; a window in the housing for transmitting forward radiation generated by the arc; and a spherical reflector on the opposite side of the electrodes from the window and having its center disposed in the arc for redirecting rearward radiation through the center to add to the forward radiation transmitted through the window.

20 Claims, 4 Drawing Sheets

ARC LAMP

FIELD OF INVENTION

This invention relates to an arc lamp, and more particularly to such an arc lamp pulsed or continuous having an internal spherical reflector and/or a back scatter deflector.

BACKGROUND OF INVENTION

Conventional arc lamps, pulsed or continuous, provide a high energy density, high intensity, sharply defined source which is desirable in a number of applications. The high energy density and high intensity make arc lamp sources desirable in spectroscopy where the chemical sensitivity is a direct function of the energy density at the target sample. The high energy density and high intensity are also useful in miniaturization applications such as in fiber optic light transmission for endoscopic uses and generally in photographic illumination applications where a high intensity minute controlled source of illumination is essential. One shortcoming of such lamps is that more than half of the radiation generated is lost because of backscattering of the rearward directed radiation within the arc lamp. Worse still, that lost, backscattered rearward radiation increases the heating of the lamp and contributes to optical noise that interferes with the output beam. In some designs paraboloidal and ellipsoidal internal reflectors have been used to collect and control more of the available arc radiation but because of electrode orientation can cause a void or black hole in the direct radiation, and each of them inadvertently increases magnification at the target which in most applications is undesirable.

SUMMARY OF INVENTION

It is therefore an object of this invention to provide an improved arc lamp of the continuous or pulsed type.

It is a further object of this invention to provide such an improved arc lamp which can substantially increase radiation output without increase in power input.

It is a further object of this invention to provide such an improved arc lamp which can substantially reduce power while maintaining radiation output.

It is a further object of this invention to provide such an improved arc lamp which conserves energy.

It is a further object of this invention to provide such an improved arc lamp which recaptures radiation emitted rearwardly away from the window and redirects through the window with the forward transmitted radiation.

It is a further object of this invention to provide such an improved arc lamp which dramatically reduces optical noise generated by the backscattered rearward directed radiation.

It is a further object of this invention to provide such an improved arc lamp which substantially reduces the heat loss in the arc lamp.

It is a further object of this invention to provide such an improved arc lamp which generates a high energy density, high intensity radiation beam without voids or holes.

It is a further object of this invention to provide such an improved arc lamp which imposes no unwanted magnification.

The invention results from the realization that a higher energy density, high intensity radiation beam can be obtained from a continuous or pulsed arc lamp by employing either or both (1) a spherical reflector having its center at the arc and disposed on the other side of the arc from the exit window to collect radiation emanating rearwardly from the arc, whose plasma is transparent to the redirected radiation, and redirect it through the center to add to the forward radiation transmitted through the window; (2) a backscatter deflector for suppressing backscattered radiation and preventing it from interfering with the forward radiation.

This invention features an arc lamp including a housing, a pair of spaced electrodes in the housing, and an inert gas in the housing for establishing an arc in the gas to generate a radiation output. There is a window in the housing for transmitting forward radiation generated by the arc. A spherical reflector on the opposite side of the electrodes from the window has its center disposed in the arc for redirecting rearward radiation through the center to add to the forward radiation transmitted through the window.

In a preferred embodiment the housing may be made of glass or metal. The window may be made of glass. The gas may be an inert gas such as xenon, krypton or argon. There may be trigger means for initiating the arc. The trigger means may include a trigger electrode and a pulsed power source and the arc lamp is a pulsed arc lamp. The trigger means may include an ignition power source and a continuous power source for a continuous arc lamp. The trigger electrode may be inside the housing. The ignition power source may include an overvoltage source. The electrodes may be aligned transverse to the direction of transmission of radiation through the window.

This invention also features an arc lamp including a housing, an inert gas in the housing and a pair of spaced electrodes in the housing for establishing an arc in the gas to generate a radiation output. There is a window in the housing for transmitting forward radiation generated by the arc and a deflector on the opposite side of the electrodes from the windows and having a rearward deflection surface for preventing backscatter radiation from the arc from passing through the arc and out the window.

In a preferred embodiment the deflector may have a forward deflection surface for receiving and redirecting backscattered radiation from the arc so that the backscattered radiation is prevented from propagating through the arc and window. The deflector may be black and may be specular. The rearward deflection surface may be flat. The forward reflection surface may be conical. The forward reflection surface may be a spherical mirror. The spherical mirror may have its center in the arc. The housing may be glass or metal. The window may be glass. The gas may be xenon, krypton or argon. There may be trigger means for initiating the arc and the trigger means may include a trigger electrode and a pulse power source wherein the arc lamp is a pulsed arc lamp. The trigger means may include an ignition power source in the continuous power source wherein the arc lamp is a continuous arc lamp. The trigger electrode may be inside the housing. The ignition power source may include an overvoltage source and the electrodes may be aligned transverse to the direction of transmission of radiation through the window.

DISCLOSURE OF PREFERRED EMBODIMENT

Other objects, features and advantages will occur to those skilled in the art from the following description of a preferred embodiment and the accompanying drawings, in which.

Figure 1:
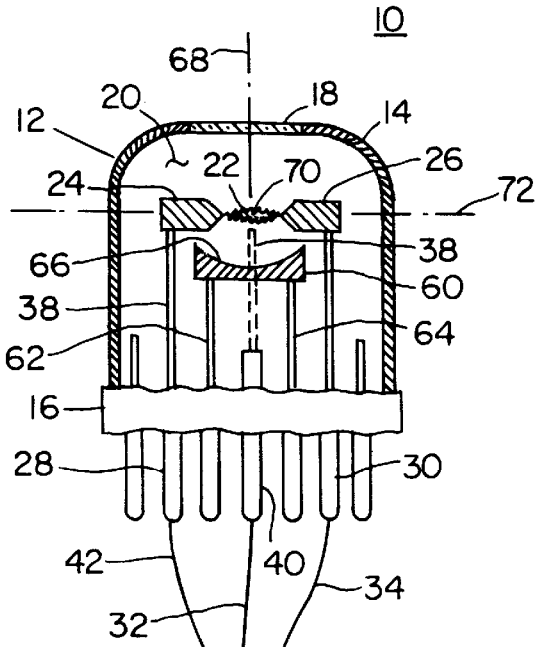
FIG. 1 is a schematic diagram of an arc lamp with pulsed power supply for operation as pulsed arc lamp employing an internal spherical reflector in accordance with the invention.

There is shown in FIG. 1 an arc lamp 10 according to this invention having a housing 12 comprised of a cover 14 and a pin press 16. Cover 14 may be made of glass or of metal such as Kovar and has a transparent window 18 that can be made of glass such as borosilicate, UV quartz or fused silicon, through which the radiation generated can be passed. Cover 14 contains an inert gas, typically argon, krypton or xenon, 20 in which a plasma arc 22 is struck between electrodes 24 and 26. Electrodes 24 and 26 are mounted on pins 28 and 30 which are electrically connected via wires 32 and 34 to pulsed power supply 36 which supplies a nominal voltage of 300–3000 volts on lines 32 and 34 to sustain an existing arc. Trigger electrode 38 proximate to the main electrodes 24 and 26 is mounted on pin 40 electrically connected through conductor 42 to pulse power supply 36 which periodically supplies a trigger pulse of 5–10 KV to periodically trigger the arc. The pulsed operation is conducted by periodic discharge of the voltage on the main electrodes 24, 26 so that the arc is extinguished and then re-triggering the arc repeatedly when the main voltage is restored. Although pins 28, 30 and 40 are shown directly connected to wires 32, 34 and 42, typically those pins engage in holes in a socket where the electrical connection is made, but the socket has been eliminated here for simplicity of illustration.

Figure 2:
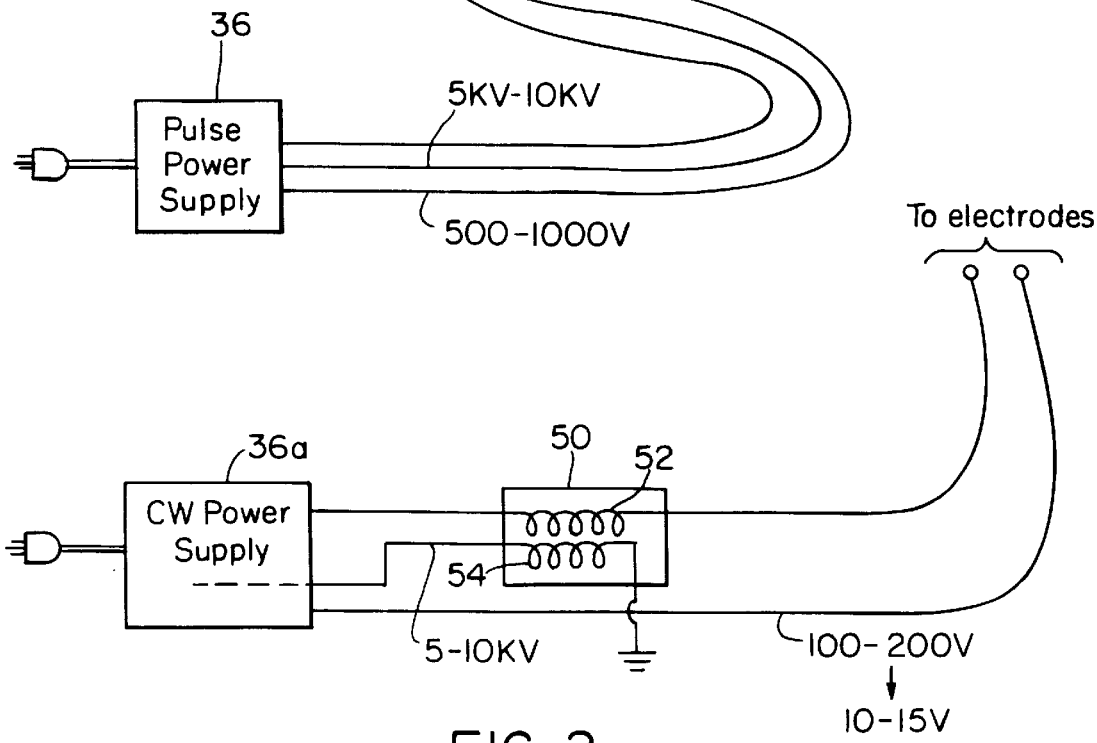
FIG. 2 is a schematic diagrammatic view of a continuous power supply for operating the arc lamp of FIG. 1 as a continuous arc lamp.

Although the arc lamp 10 has been explained thus far as a pulsed arc lamp, this is not a necessary limitation of the invention; it may be a continuous wave arc lamp as well. In that case, the pulsed power supply 36 is replaced by a continuous wave power supply 36*a*, FIG. 2, which provides power to electrodes 24 and 26 through wires 32*a* and 34*a*.

In that case arc 22 is triggered or ignited by igniter 50 which may include a coil 52 in series with conductor 32*a* inductively coupled with a second coil 54 grounded at one end and connected to power supply 36*a* at the other, whereby an induced nominal voltage of 5–10 K is impressed on coil 54 by power supply 36*a* and the collapsing field induces a voltage of 5–10 KV in coil 52 which momentarily propagates through conductor 32*a*, appears across electrodes 24 and 26 and strikes the arc, after which the continuous supply of 100–200 volts on lines 32*a* and 34*a* sustains the arc. Once the arc is struck and fully operational the voltage across it typically drops to 10–20 volts.

In either operation, regardless of whether arc lamp 10 is operated as a pulsed or continuous wave arc, a spherical mirror 60, FIG. 1, is provided. Mirror 60 is supported, for example, on two unconnected pins 62 and 64 so that the spherical surface 66 is on the opposite side of arc 22 from window 18 and the optical axis 68 of mirror 60 passes directly through arc 22 and the geometric center 70 of spherical surface 66 is in or about arc 22 on axis 68. As shown, electrodes 24 and 26 are aligned on axis 72 transverse to the optical axis 68 which extends through mirror 60 and window 18, but it is not necessary that they be aligned. The use of the spherical mirror in this position provides a number of advantages.

Figure 3:
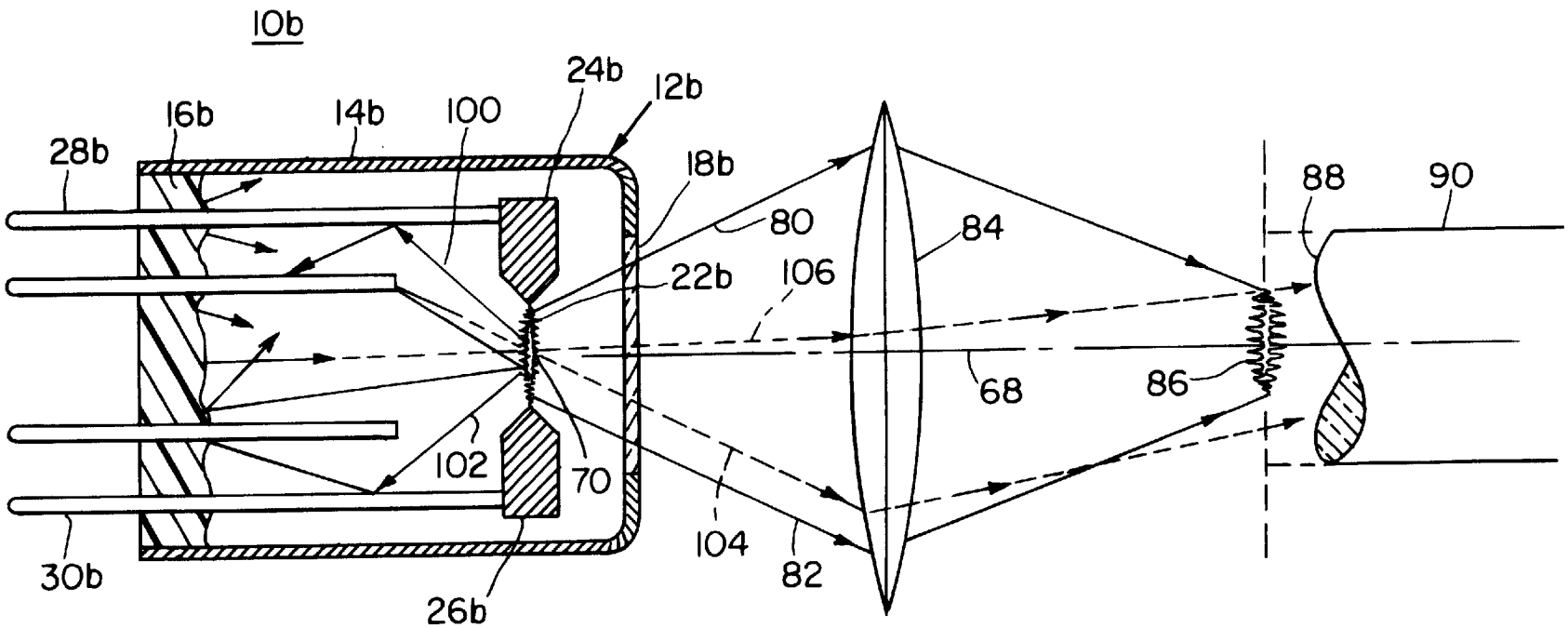
FIG. 3 PRIOR ART
FIG. 3 is a ray diagram of a prior art arc lamp without the internal spherical reflector of this invention showing loss of rearwardly directed radiation and creation of optical noise.

As shown in the prior art device, arc lamp 10*b*, FIG. 3, emits forward transmitted light indicated by rays 80, 82 which are transmitted through window 18*b* and captured by lens 84 to produce the image 86 of arc 22*b* at a target plane such as the input aperture 88 of the fiber optic element 90. However, in this prior art arc lamp, fully half of the light escapes rearwardly as indicated by rays 100, 102 from arc 22*b* so that this light, roughly half of the light output energy, is lost to the system, making it highly inefficient. In addition, this radiation as indicated by rays 100 and 102, bounces around or backscatters off the pins and the surface of pin press 16*b* and some of that backscattered radiation passes through plasma arc 22*b* which is transparent and, as shown by rays 104 and 106, propagates through window 18*b* and lens 84. But it is not focussed at the site of the image 86 of the arc. Instead it is scattered about and causes a substantial amount of optical noise.

Figure 4:
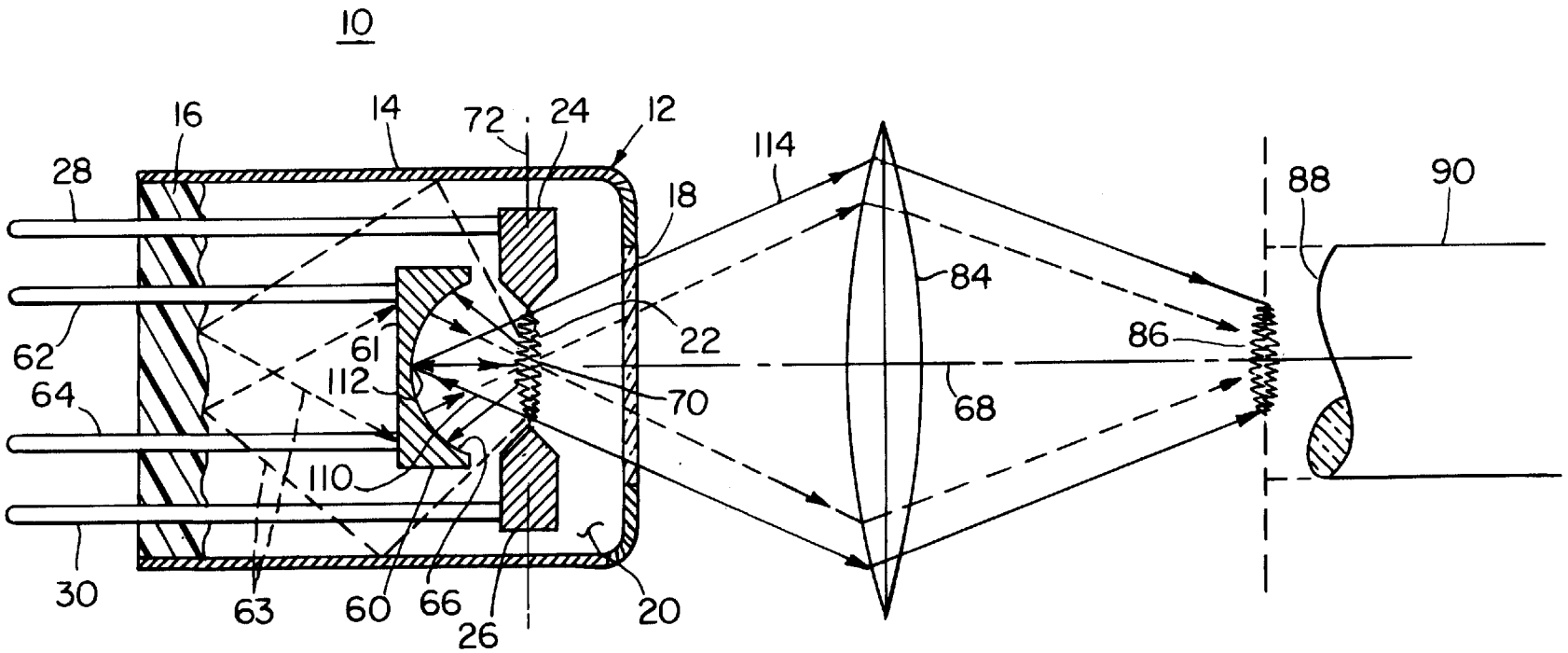
FIG. 4 is a ray diagram similar to FIG. 3 of an arc lamp with the internal spherical reflector of this invention showing the redirecting of rearwardly directed radiation and elimination of optical noise.

In accordance with this invention spherical mirror 60, FIG. 4 with its spherical surface 66 on the opposite side of arc 22 from window 18, captures the rearward exiting rays and redirects them through the transparent arc 22 and mirror 18 so that they add to the forward transmitted rays and are combined to focus at the same site of the image 86 of arc 22. For example, ray 110 traveling backwards from the edge of arc 22 proximate electrode 26 strikes mirror surface 66 at point 112 and then is reflected out as ray 114 to lens 84. Any radiation emanating from near the center 70 of spherical surface 66 in arc 22 is reflected back through that center 70 and is also collected by lens 84, thus making a small, sharp focus of the image at 86 well within the aperture 88 of fiber optic element 90. Thus spherical mirror 60 not only approximately doubles the light output for the same power, or conversely can provide the same light output for roughly half the power, but it also eliminates or at least dramatically reduces the optical noise that was previously present due to the backscattering of the rearwardly directed radiation. Any small amount of radiation that might escape past mirror 60 to the area behind it would be blocked by the deflection surface 61 on its rearward end as depicted by rays 63.

Figure 5:
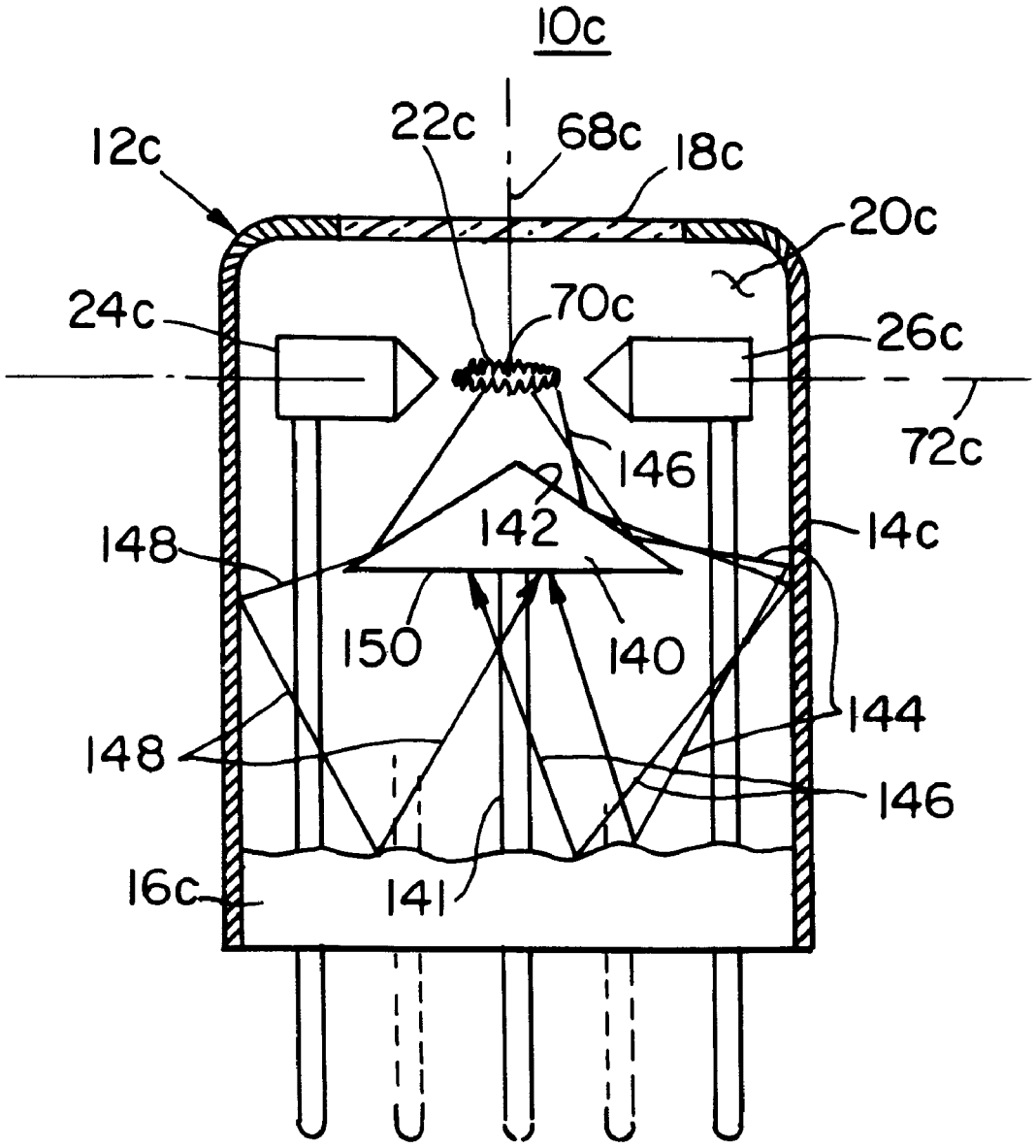
FIG. 5 is a view of the arc lamp of FIG. 1 with a deflector only and no spherical mirror.

Although the embodiment illustrated thus far uses a combination of a spherical mirror 60 with a deflection surface 61 on its rearward end, this is not a necessary limitation of the invention as the use of a deflection surface above can achieve significantly improved efficiency. For example, a conical deflector 140, FIG. 5, can be provided on mount 141 with a forward deflector surface 142 for receiving and redirecting backscattered rays 144, 146, 148 so that they strike the rearward deflector surface 150 and are prevented from propagating through the arc 22*a* and out window 18*c*. Although forward deflector surface 142 is shown conical and rearward deflector surface 150 is flat, these are not necessary limitations of the invention as the shape will be determined by particular lamp dimensions and configuration to ensure against rearward radiation rebounding back through window 18*c*. Deflector 140 is preferably black to absorb most (typically 95 %) of the incident radiation and specular to prevent diffuse emanation from the deflector.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An arc lamp comprising:

a housing;

an inert gas in said housing;

a pair of spaced electrodes in said housing for establishing an arc in said gas to generate a radiation output;

a window in said housing for transmitting forward radiation generated by the arc; and a deflector on the opposite side of said electrodes from said window and having a rearward deflection surface for preventing backscattered radiation from said arc from passing through said arc and out said window.

2. The arc lamp of claim 1 in which said deflector has a forward deflection surface for receiving and redirecting backscattered radiation from said arc so that said backscattered radiation is prevented from propagating through said arc and window.

3. The arc lamp of claim 1 in which said deflector is black.

4. The arc lamp of claim 1 in which said deflector is specular.

5. The arc lamp of claim 1 in which said rearward deflector surface is flat.

6. The arc lamp of claim 2 in which said forward deflector surface is conical.

7. The arc lamp of claim 2 in which said forward deflector surface is a spherical mirror.

8. The arc lamp of claim 7 in which the spherical mirror has its center in the arc.

9. The arc lamp of claim 1 in which said housing is glass.

10. The arc lamp of claim 1 in which said housing is metal.

11. The arc lamp of claim 1 in which the window is glass.

12. The arc lamp of claim 1 in which said gas is xenon.

13. The arc lamp of claim 1 in which said gas is krypton.

14. The arc lamp of claim 1 in which said gas is argon.

15. The arc lamp of claim 1 further including trigger means for initiating the arc.

16. The arc lamp of claim 15 in which said trigger means includes a trigger electrode and a pulsed power source and the arc lamp is a pulsed arc lamp.

17. The arc lamp of claim 15 in which said trigger means includes an ignition power source and a continuous power source and the arc lamp is a continuous arc lamp.

18. The arc lamp of claim 16 in which said trigger electrode is inside the housing.

19. The arc lamp of claim 17 in which said ignition power source includes an overvoltage source.

20. The arc lamp of claim 1 in which the electrodes are aligned transverse to the direction of transmission of radiation through the window.

* * * * *